US011140990B2

(12) United States Patent
Sun

(10) Patent No.: US 11,140,990 B2
(45) Date of Patent: Oct. 12, 2021

(54) CHAIR SUPPORT STRUCTURE AND CHAIR HAVING THE SAME

(71) Applicant: HAINING MY HOME MECHANISM CO., LTD., Haining (CN)

(72) Inventor: Xiqi Sun, Huzhou (CN)

(73) Assignee: HAINING MY HOME MECHANISM CO., LTD., Haining (CN)

( * ) Notice: Subject to any disclaimer, the term of this patent is extended or adjusted under 35 U.S.C. 154(b) by 0 days.

(21) Appl. No.: 16/849,880

(22) Filed: Apr. 15, 2020

(65) Prior Publication Data

US 2021/0219725 A1 Jul. 22, 2021

(30) Foreign Application Priority Data

Jan. 17, 2020 (CN) ..... 202010054205.3
Jan. 17, 2020 (CN) ..... 202020115423.9

(51) Int. Cl.
*A47C 7/14* (2006.01)
*A47C 7/28* (2006.01)
*A47C 1/024* (2006.01)

(52) U.S. Cl.
CPC ..... *A47C 7/144* (2018.08); *A47C 1/024* (2013.01); *A47C 7/28* (2013.01)

(58) Field of Classification Search
CPC ..... A47C 7/144; A47C 1/024; A47C 1/0242; A47C 7/28
See application file for complete search history.

(56) References Cited

U.S. PATENT DOCUMENTS

| | | | | |
|---|---|---|---|---|
| 8,297,693 | B2 * | 10/2012 | Hoffman | A47C 3/0255 297/85 M |
| 9,357,847 | B2 * | 6/2016 | Murphy | A47C 1/034 |
| 9,603,452 | B2 * | 3/2017 | Murphy | A47C 1/03294 |
| 10,258,158 | B2 * | 4/2019 | Fei | A47C 1/0355 |
| 10,327,553 | B2 * | 6/2019 | Kiwak | A47C 1/0242 |
| 10,524,574 | B2 * | 1/2020 | LaPointe | A47C 7/506 |
| 10,561,244 | B2 * | 2/2020 | Lapointe | A47C 1/0355 |
| 10,682,271 | B2 * | 6/2020 | Lin | A61G 5/14 |
| 10,842,273 | B2 * | 11/2020 | Fei | A47C 7/5062 |
| 11,006,753 | B2 * | 5/2021 | Carrera | A47C 7/506 |
| 2013/0175847 | A1 * | 7/2013 | Lawson | A61G 5/14 297/85 M |
| 2015/0282619 | A1 * | 10/2015 | Lawson | A47C 1/0355 297/83 |

* cited by examiner

*Primary Examiner* — Philip F Gabler

(57) ABSTRACT

A chair support structure includes a base, a driving component, a first transmission component, a leg component, and a back component. The driving component can be connected to the base, the first transmission component is connected to the driving component. Both the leg component and the back component are connected to the first transmission component. The first transmission component can include a first transmission member. The first transmission member can include a first connection portion and a second connection portion, each of which has a first end and a second end opposite to each other. The first end of the first connection portion can be pivotally connected to the leg component. The second end of the first connection portion can be fixed to the second connection portion. An angle can be formed between the first connection portion and the second connection portion.

18 Claims, 12 Drawing Sheets

CHAIR SUPPORT STRUCTURE AND CHAIR HAVING THE SAME

CROSS REFERENCE TO RELATED APPLICATIONS

This application claims all benefits accruing under 35 U.S.C. § 119 from China Patent Application Nos. 202020115423.9, filed on Jan. 17, 2020, and 202010054205.3, filed on Jan. 17, 2020, in the China National Intellectual Property Administration, the content of which is hereby incorporated by reference.

TECHNICAL FIELD

The present disclosure relates to chairs, and in particular, to a chair support structure and a chair having the chair support structure.

BACKGROUND

A chair support structure is a mechanical device in a chair. Through a mechanical transmission, an angle of a back portion of the chair can be adjusted, a leg portion thereof can be extended, and a height of the chair can be adjusted. In general, the chair usually drives the back portion and the leg portion to be adjusted through two driving members, respectively, which has a high cost and a complicated structure, resulting in poor efficiency of production and inconvenience of installation.

SUMMARY

For an embodiment of the present disclosure includes a chair support structure, including a base, a driving component, a first transmission component, a leg component, and a back component. The driving component can be connected to the base, and the first transmission component is connected to the driving component. Both the leg component and the back component are connected to the first transmission component.

The first transmission component can include a first transmission member. The first transmission member can include a first connection portion and a second connection portion, each of which has a first end and a second end opposite to each other. The first end of the first connection portion can be pivotally connected to the leg component. The second end of the first connection portion can be fixed to the second connection portion. An angle can be formed between the first connection portion and the second connection portion. The first end of the second connection portion can be pivotally connected to the back component, and the second end of the second connecting portion can be connected to the driving component.

The driving component can include a driving member. The driving member can be connected to the base. An output end of the driving member can be connected to the second end of the second connecting portion. The driving member can be configured for driving the first transmission member to move relative to the base, resulting in the first connecting portion extending or contracting the leg component, and the second connection portion driving the back component to rotate relative to the base to adjust an angle of the back component.

In the chair support structure provided by the present disclosure, the driving member can make the first transmission member move, the first connection portion of the first transmission member can drive the leg component to extend or contract, and the second connection portion of the first transmission member can drive the back component to adjust an angle thereof. So that a basic function of the chair support structure can be realized through the structure of the driving member and the first transmission member, realizing that the structure of the chair support structure can be simplified, the production and assembly of the chair support structure can be facilitated, and the production cost can be reduced.

A plurality of alternative embodiments can be provided as follows, but it is not intended as a limit on the above-mentioned scheme. It is only a further extension scheme. Without technical or logical contradictions, each of the alternative embodiments can be performed separately or in combination for the above-mentioned scheme.

In one embodiment, the first transmission component can further include a second transmission member, a third transmission member, a fourth transmission member, a fifth transmission member, and a sixth transmission member, each of which has a first end and a second end opposite to each other. The first end of the second transmission member can be pivotally connected to the second end of the second connection portion. The second end of the second transmission member can be pivotally connected to the first end of the third transmission member. A middle portion of the third transmission member between the first end and the second end can be pivotally connected to the base. The second end of the third transmission member can be pivotally connected to the first end of the fourth transmission member, and the second end of the fourth transmission member can be pivotally connected to the first end of the fifth transmission member. The second end of the fifth transmission member can be pivotally connected to the sixth transmission member, and the sixth transmission member can be pivotally connected to the base.

Furthermore, a guide groove can be disposed on the sixth transmission member. The fifth transmission member can be provided with a guide portion coupled to the guide groove, which is slidable along the guide groove. The output end of the driving member can be connected to the fifth transmission member, and the driving member can be configured to drive the fifth transmission member, the fourth transmission member, the third transmission member and the second transmission member to move, resulting in driving the first transmission member to move.

In one embodiment, an edge of the sixth transmission member can extend outward to form a lifting portion abutting against the base. The chair support structure can further include a connecting member abutting against the lifting portion. And the first transmission component, the leg component and the back component can be pivotally connected to the connecting member.

In one embodiment, the chair support structure can further include a support member having a first end and a second end opposite to each other. The first end of the support member can be fixed to the connecting member and the second end of the support member can be pivotally connected to the middle portion of the third transmission member, and the third transmission member can be rotatable relative to the support member, driven by the driving member, and drives the second transmission member and the first transmission member to rotate.

In one embodiment, the back component can include a first back member, a second back member, a third back member, a fourth back member, a fifth back member, a sixth back member, a seventh back member, an eighth back member, a back plate, and an angle adjusting member. The back plate can be pivotally connected to the leg component. A first end of the first back member can be pivotally connected to a first end of the second connecting portion. A second end of the first back member opposite to the first end thereof can be pivotally connected to a first end of the second back member. A second end of the second back member opposite to the first end thereof can be pivotally connected to the third back member. A first end of the third back member can be pivotally connected to the connecting member. A second end of the third back member opposite to the first end thereof can be pivotally connected to the fourth back member. The fourth back member can be pivotally connected to the back plate. A first end of the fifth back member can be pivotally connected to the fourth back member. A second end of the fifth back member opposite to the first end thereof can be pivotally connected to the sixth back member. A first end of the seventh back member can be pivotally connected to the sixth back member, and a second end of the seventh back member opposite to the first end thereof is pivotally connected to the connecting member.

Furthermore, a first end of the eighth back member can be pivotally connected to the sixth back member. A second end of the eighth back member opposite to the first end thereof can be pivotally connected to the angle adjusting member. The angle adjusting member can be pivotally connected to the back plate at the same time.

Furthermore, the chair support structure can include a first elastic member. And two ends of the first elastic member can be connected to the back plate and the first connection portion, respectively.

Furthermore, the chair support structure can include a second elastic member. And two ends of the second elastic member can be connected to the back plate and the sixth back member, respectively.

Furthermore, the chair support structure can include a lifting component. The lifting component can include a fixing member, a first lifting member and a second lifting member. The fixing member can be fixed to the base. A first end of the first lifting member can be pivotally connected to the sixth transmission member. A second end of the first lifting member opposite to the first end thereof can be pivotally connected to the fixing member. A first end of the second lifting member can be pivotally connected to the sixth driving member, and a second end of the second lifting member opposite to the first end thereof is pivotally connected to the fixing member.

Furthermore, the driving member can be configured to drive the sixth transmission member to rotate relative to the fixing member through the first lifting member and the second lifting member. The sixth transmission member can be configured to make the connecting member rotate relative to the base through the lifting portion.

The present disclosure further provides a chair comprising the chair support structure.

The chair of the present disclosure having the chair support structure can have a low production cost and a broad application.

DETAILED DESCRIPTION

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the disclosure.

It should be noted that when an element is referred to as being "assembled on" another element, it may be directly or indirectly disposed on another element. When an element is considered to be "fixed" to another element, it may be directly or indirectly attached to another element.

All technical and scientific terms used herein have the same meaning as commonly understood by one of ordinary skill in the art to which this disclosure is claimed. The terminology used in the description herein is for the purpose of describing particular embodiments, and is not intended to limit the disclosure. The term "or/and" as used herein includes any and all combinations of one or more of the associated listed items.

Figure 1:
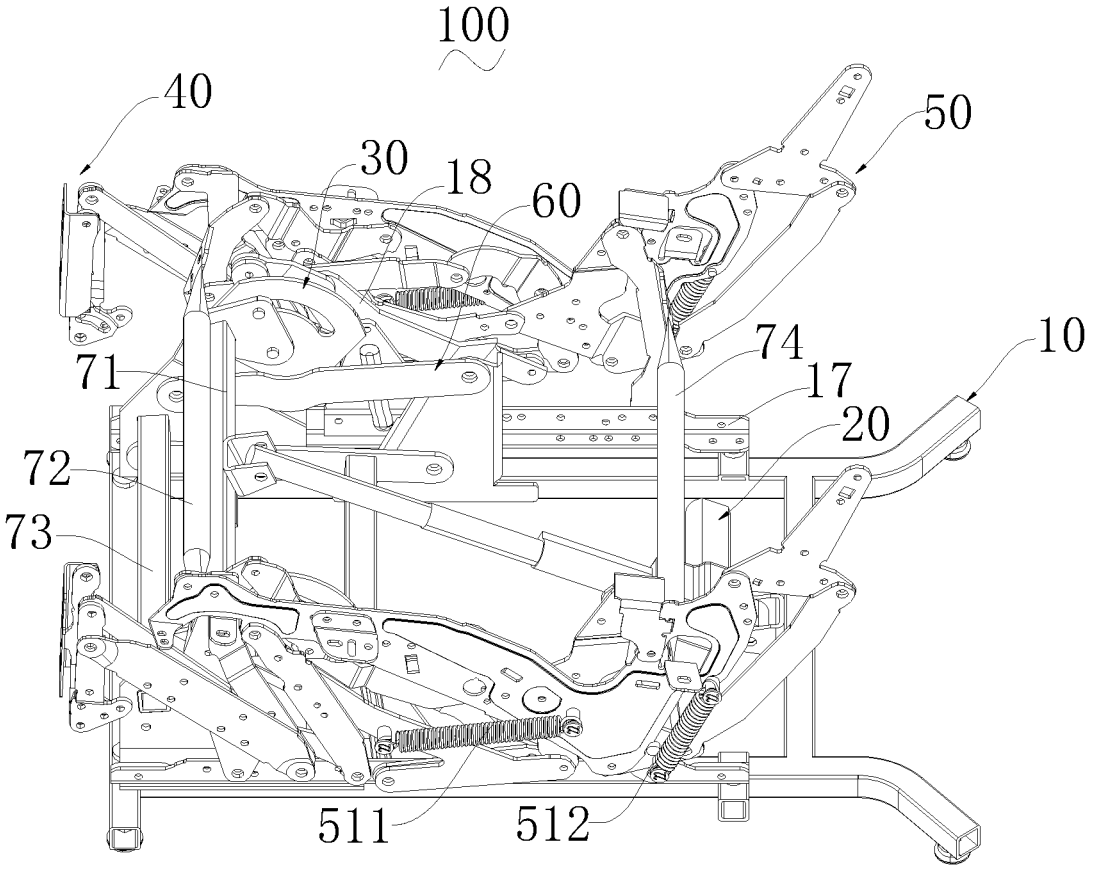
FIG. 1 is a schematic view of a chair support structure provided by the present disclosure.

Referring to FIG. 1, a chair support structure 100 is provided. The chair support structure 100 can be arranged in a chair in order to realize functions such as leg extension, back adjustment, and seat elevation, thereby facilitating using and improving comfortability.

A chair support structure can include a base 10, a driving component 20, a first transmission component 30, a leg component 40, and a back component 50. The driving component 20 can be connected to the base 10. The first transmission component 30 can be connected to the driving component 20. Both the leg component 40 and the back component 50 can be connected to the first transmission component 30. The base 10 can be configured for supporting each component. The driving component 20 can provide driving force for the movement of the chair support structure 100. The first transmission component 30 can drive the leg component 40 to expand or contract and drive the back component 50 to adjust angle itself.

Figure 6:
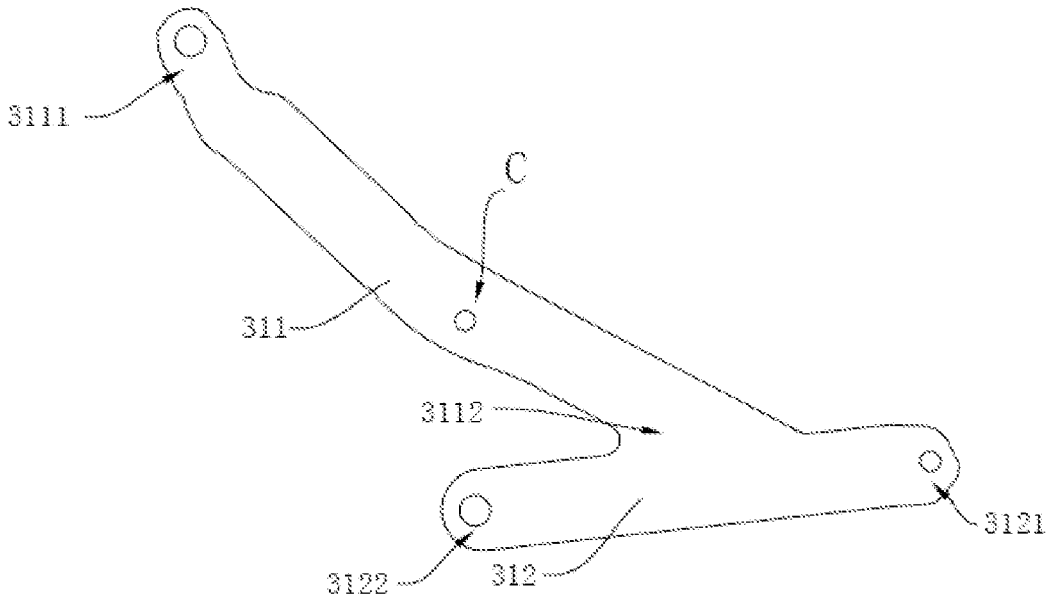
FIG. 6 is a schematic view of a first transmission member of the first transmission component of FIG. 4.

Referring to FIG. 6, the first transmission component can include a first transmission member 31. The first transmission member 31 can include a first connection portion 311 and a second connection portion 312. Referring to FIG. 6, the first connection portion 311 and the second connection portion 312 each can have a first end and a second end opposite to each other. The first end 3111 of the first connection portion 311 can be pivotally connected to the leg component 40, and the second end 3112 of the first connection portion 311 can be fixed to the second connection portion 312. An angle can be formed between the first connection portion 311 and the second connection portion 312. The first end 3121 of the second connection portion 312 can be pivotally connected to the back component 50, and the second end 3122 of the second connecting portion 312 is connected to the driving component 20.

The driving component 20 can include a driving member 21. The driving member 21 can be connected to the base 10. An output end of the driving member 21 can be connected to the second end 3122 of the second connecting portion 312. The driving member 21 can be configured for driving the first transmission member 31 to move relative to the base 10, resulting in that the first end 3111 of the first connecting portion 311 can drive the leg component to extend or contract, and the first end 3121 of the second connection portion 312 can drive the back component 50 to rotate relative to the base 10 to adjust the angle of the back component 50, thereby the leg component 40 and the back component 50 can be adjusted through the first transmission member 31.

In the chair support structure 100, the driving member 21 can drive the first transmission member 31 to move. The first connection portion 311 of the first transmission member 31 can drive the leg component 40 to expand or contract, and the second connecting portion 312 of the first transmission member 31 can drive the back component 50 to adjust the angle itself. So that the chair support structure 100 can be adjusted partly through the driving member 21 and the first transmission member 31, the structure of the chair support structure 100 can be simplified, the production of the chair support structure 100 can be simplified, and production costs can be reduced.

Figure 2:
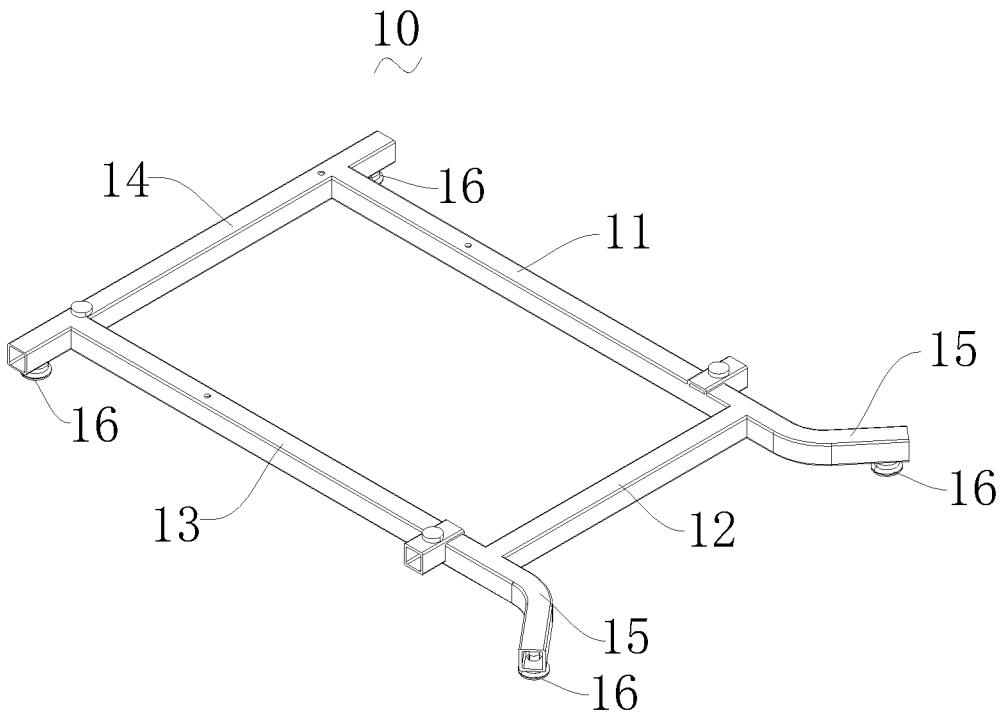
FIG. 2 is a schematic view of a base of the chair support structure of FIG. 1.

Referring to FIG. 2, the base 10 can include a first support rod 11, a second support rod 12, a third support rod 13, and a fourth support rod 14. The first support rod 11, the second support rod 12, the third support rod 13, and the fourth support rod 14 each can have a first end and a second end opposite to each other. The first end of the first support rod 11 can be fixed to the first end of the second support rod 12 and the second end of the second support rod 12 can be fixed to the first end of the third support rod 13. The second end of the third support rod 13 can be fixed to the first end of the fourth support rod 14, and the second end of the fourth support rod 14 can be fixed to the first end of the first support rod 11. Therefore, the first support rod 11, the second support rod 12, the third support rod 13, and the fourth support rod 14 can be in a rectangular shape, thereby forming the base 10 of the chair support structure 100.

Referring to FIG. 2, both the first support rod 11 and the third support rod 13 can extend outward and form a reinforcement portion 15. The reinforcement portion 15 can be configured for increasing the range of supporting for the chair support structure 100. When one side of the chair support structure 100 is relatively stressed, at this time, the reinforcement portion 15 can effectively prevent the chair support structure 100 from turning over, and improve the safety of the chair support structure 100.

It should be noted that the shape surrounded by the first support rod 11, the second support rod 12, the third support rod 13, and the fourth support rod 14 is not limited to the rectangular shape and can substantially be a quadrilateral. Hereinafter, the "first end" and "second end" of each rod will be used directly, only indicating that the rod can have a relatively two ends, and a shape of the rod can be not limited to a line, and can be in a regular or irregular shape.

Both ends of the fourth support rod 14, the reinforcement portions 15 of the first support rod 11 and the third support rod 13 can be provided with anti-friction pads 16. The arrangement of the anti-friction pads 16 can prevent the chair support structure 100 from being easily sliding, and improve the stability of the chair support structure 100, which is beneficial to the safety of the chair support structure 100.

Figure 3:
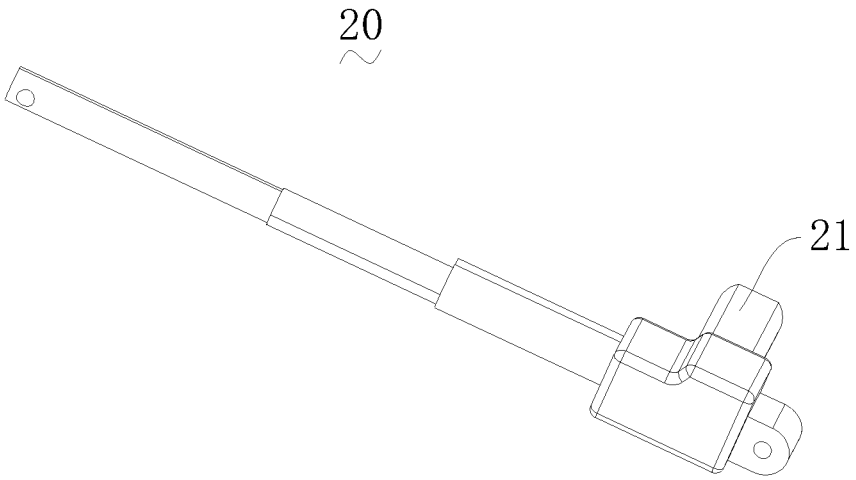
FIG. 3 is a schematic view of a driving member of the chair support structure of FIG. 1.

Referring to FIG. 3, the driving component 20 can include a driving component 21. The driving component 21 can be pivotally connected to the second support rod 12. The output end of the driving component 21 can be connected to the first transmission component 30 and be configured for driving the first transmission component 30 to move. In this embodiment, the driving member 21 can be a motor, such as a screw motor. The screw motor can have advantages of stable transmission and high output accuracy, and be suitable for the chair support structure 100 for accurately adjusting. It can be understood that, in other embodiments, the driving member 21 may also be other types of motors or other types of driving sources, as long as it can drive as described above.

Figure 4:
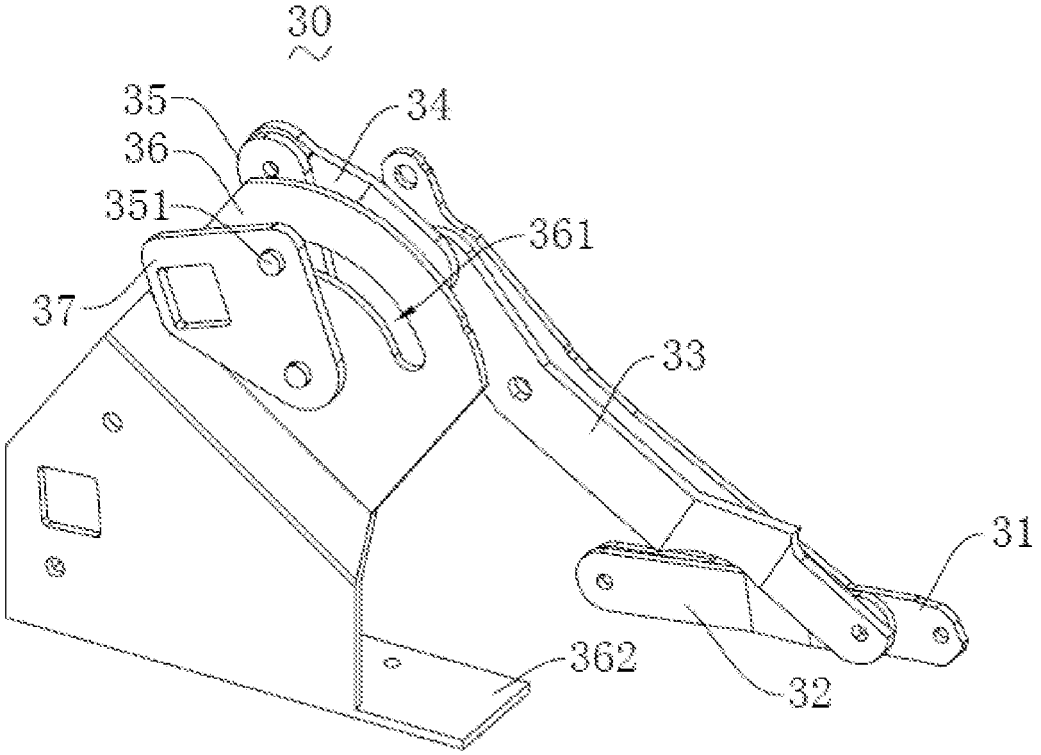
FIG. 4 is a schematic view of a first transmission component of the chair support structure of FIG. 1.
Figure 5:
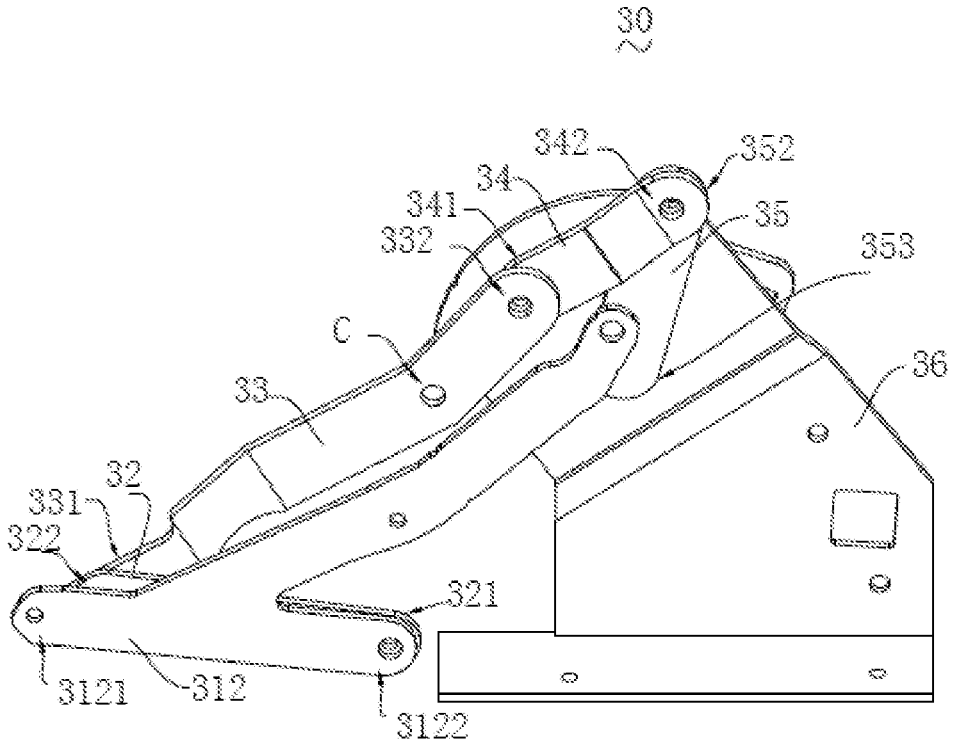
FIG. 5 is another schematic view of the first transmission component of FIG. 4.

Referring to FIG. 4, FIG. 5, and FIG. 6, the first transmission component 30 can include a first transmission member 31, a second transmission member 32, a third transmission member 33, a fourth transmission member 34, a fifth transmission member 35, and a sixth transmission member 36. The sixth transmission member 36 can be pivotally connected to the first support rod 11. A guide groove 361 can be defined in the sixth transmission member 36. The first end 352 of the fifth transmission member 35 can be pivotally connected to the sixth transmission member 36. The fifth transmission member 35 can be provided with a guide portion 351 coupled to the guide groove 361. The second end 353 of the fifth transmission member 35 can be pivotally connected to the first end 341 of the fourth transmission member 34, and the second end 342 of the fourth transmission member 34 can be pivotally connected to the first end of 331 the third transmission member 33. The third transmission member 33 can be pivotally connected to the base 10. The second end 332 of the third transmission member 33 can be pivotally connected to the first end 321 of the second transmission member 32. And the second end 322 of the second transmission member 32 can be pivotally connected to the first transmission member 31.

The output end of the driving member 21 can be connected to the fifth transmission member 35. When the fifth transmission member 35 rotates relative to the sixth transmission member 36 by the driving member 21, the guide portion 351 will slide along the guide groove 361, and the fifth transmission member 35 will drive the fourth transmission member 34 to move in order that the third transmission member 33 will rotate relative to the base 10. The third transmission member 33 will drive the first transmission member 31 to move through the second transmission member 32. When the first transmission member 31 moves, it can drive the leg component 40 to expand or contract through the first connection portion 311, and further drive the back component 50 to rotate to achieve angle adjustment through the second assembly 312.

In this embodiment, the fifth transmission member 35 can move from one end of the guide groove 361 close to the leg component 40 to the other end of the guide groove 361 away from the leg component 40. The first transmission component 30 can push the leg component 40, and then the leg component 40 can be in a stretching state. Alternatively, the leg component 40 can be in a contracted state.

Figure 7:
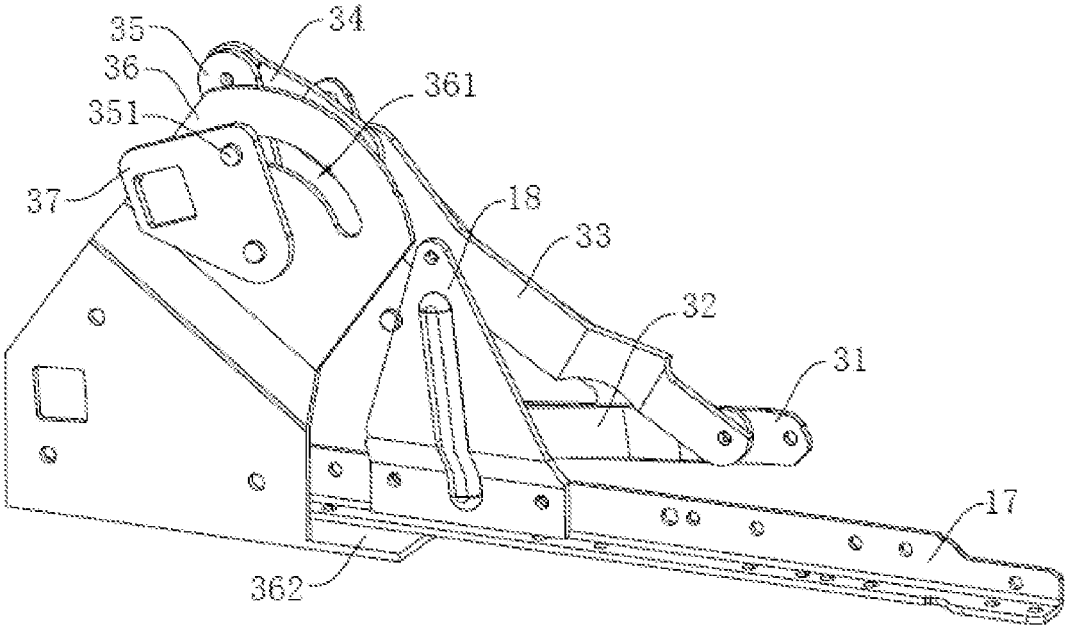
FIG. 7 is a schematic view of the first transmission member and other members.

Referring to FIG. 4 and FIG. 7, the chair support structure 100 can further include an intermediate plate 37, which can be pivotally connected to the guide portion 351, the fifth transmission member 35 to the sixth transmission member 36. The output end of the driving member 21 can be pivotally connected to the intermediate plate 37. Furthermore, the driving member 21 can drive the fifth transmission member 35 to rotate relative to the sixth transmission member 36 around a pivot point through the intermediate plate 37, so as to achieve the corresponding transmission relationship. In other embodiments, the driving member 21 can also directly connected to the guide portion 351.

Referring to FIG. 7, an edge of the sixth transmission member 36 extending outward forms a lifting portion 362, which abuts against the base 10. The chair support structure 100 can further include a connecting member 17 and a support member 18. The connecting member 17 can abut against the lifting portion 362. The support member 18 can be fixed to the connecting member 17. The third transmission member 33 can be pivotally connected to the support member 18, and then can be indirectly articulated to the base 10. The third transmission member 33 can rotate relative to the support member 18 around the pivot point C, thereby driving the second transmission member 32 and the first transmission member 31 to rotate. Both the leg component 40 and the back component 50 can be pivotally connected to the connecting member 17.

In this embodiment, the supporting member 18 can be in a substantially triangular shape. Two corners of the supporting member 18 can be fixed to the connecting member 17, and a third corner of the supporting member 18 can be pivotally connected to the third rotating member 33 to ensure the stability of the supporting member 18 relative to the connecting member 17. It can be understood that, in other embodiments, the support member 18 can also be in other shapes, as long as it can achieve the above purpose.

The sixth transmission member 36 can extend and bent outward by ninety degrees to form the lifting portion 362, that is, the lifting portion 362 can be perpendicular to other portions of the sixth transmission member 36. It can be understood that, in other embodiments, the sixth transmission member 36 can also form the lifting portion 362 by bending at other angles.

Referring to FIG. 8, FIG. 9, FIG. 10, and FIG. 11, the leg component 40 can include a first leg member 41, a second leg member 42, a third leg member 43, a fourth leg member 44 and a fifth leg member 45. The first leg member 41 can be pivotally connected to the first connecting portion 311. A first end of the first leg member 41 can be pivotally connected to the back component 50, and a second end of the first leg member 41 can be pivotally connected to a first end of the second leg member 42. A second end of the second leg member 42 can be pivotally connected to the third leg member 43. A first end of the fourth leg member 44 can be pivotally connected to the back component 50. The fourth leg member 44 can be pivotally connected to the second leg member 42. A second end of the fourth leg member 44 can be pivotally connected to a first end of the fifth leg member 45, and a second end of the fifth leg member 45 can be pivotally connected to the third leg member 43. Driven by the first connecting portion 311, the first leg member 41 can rotate relative to the back component 50 and drive the second leg member 42 to rotate. The second leg member 42 can further drive the fifth leg member 45 to rotate through the fourth leg member 44, and the second end of the second leg member 42 and the second end of the fifth leg member 45 can drive the third leg member 43 to rotate, so as to achieve the extension or contraction of the leg component 40.

The extension and contraction of the leg component 40 can change the chair support structure 100 to a variety of states in use, improving the comfort of the user and meeting the needs of the user.

Figure 8:
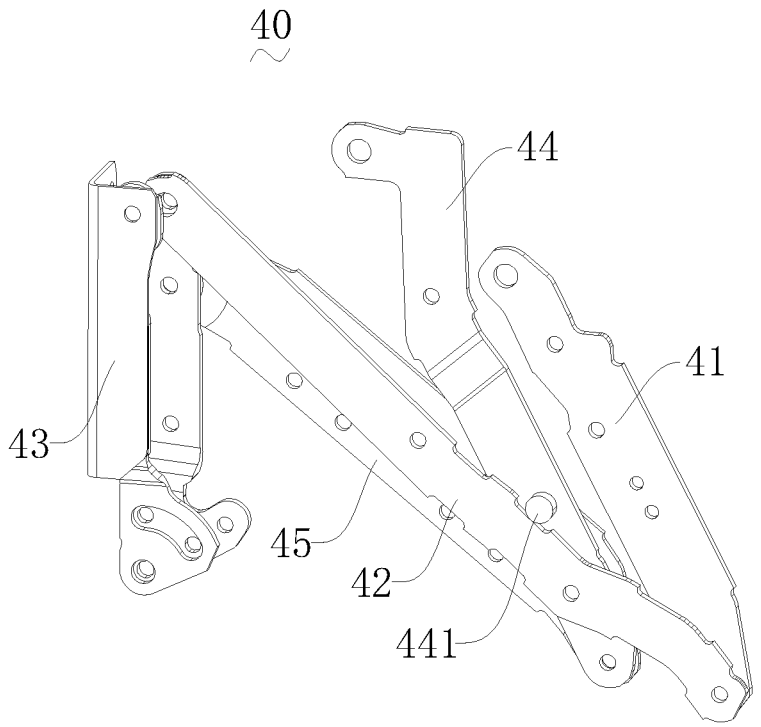
FIG. 8 is a schematic view of a leg component of the chair support structure of FIG. 1 in a contracted state.
Figure 9:
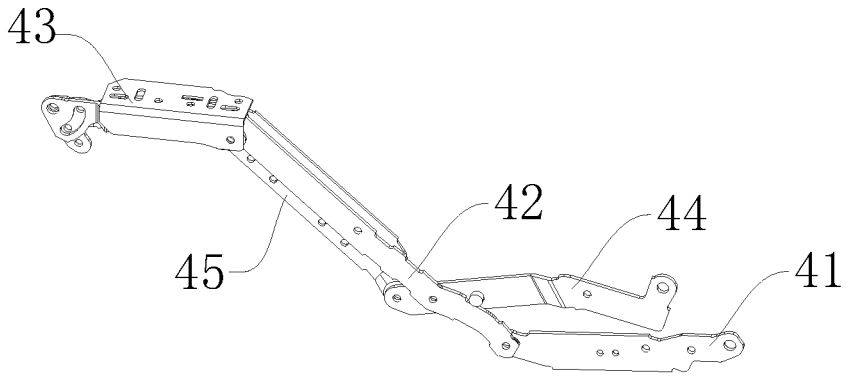
FIG. 9 is a schematic view of the leg component of FIG. 8 in an extended state.
Figure 10:
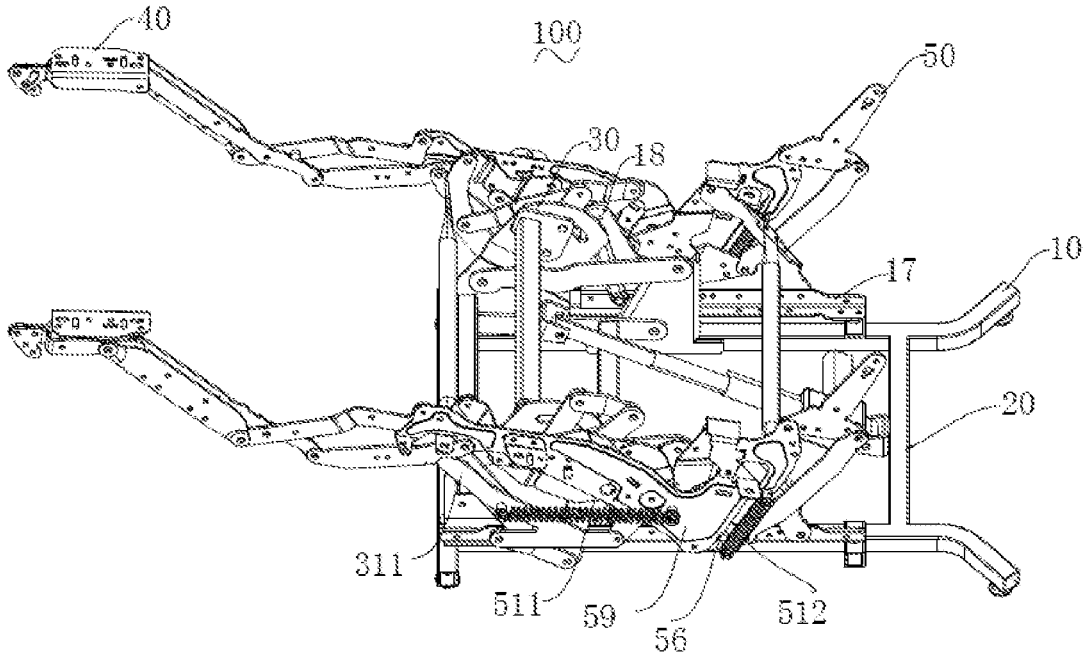
FIG. 10 is a schematic view of the chair support structure of FIG. 1 in a partially folded state.
Figure 11:
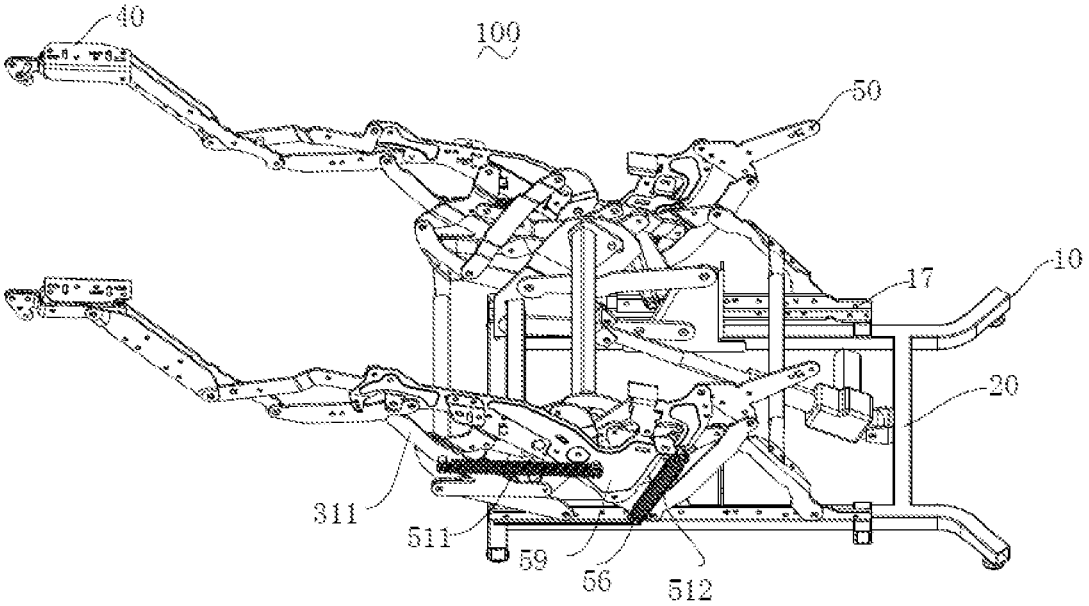
FIG. 11 is a schematic view of the chair support structure of FIG. 1 in an unfolded state.

Referring to FIG. 8, the fourth leg member 44 can further include an abutting portion 441. When the leg component 40 is in the contracted state, the abutting portion 441 can abut the second leg member 42, thereby allowing a gap between each leg member to prevent each leg member cannot be extended again due to too compact, which is beneficial to the normal use of the chair support structure 100.

Figure 12:
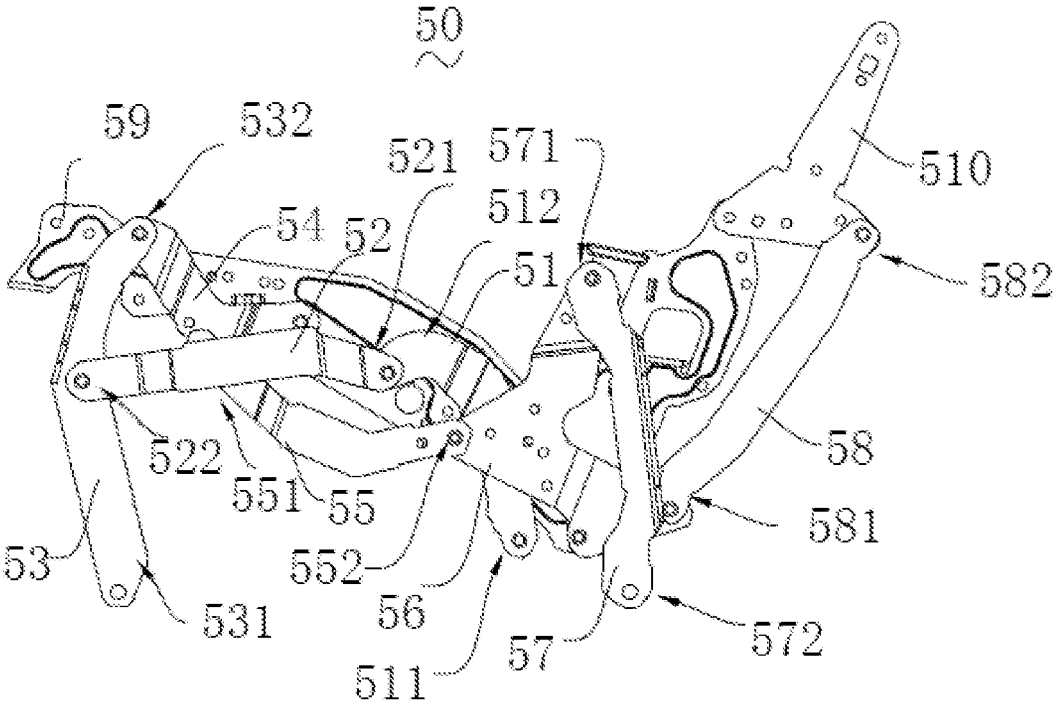
FIG. 12 is a schematic view of a back component of the chair support structure of FIG. 1.

Referring to FIG. 12, the back component 50 can include a first back member 51, a second back member 52, a third back member 53, a fourth back member 54, a fifth back member 55, a sixth back member 56, a seventh back member 57, an eighth back member 58, a back plate 59 and an angle adjusting member 510. Both the first leg member 41 and the second leg member 42 can be pivotally connected to the back plate 59. The first back member 51 can be pivotally connected to the back plate 59. A first end 511 of the first back member 51 can be pivotally connected to the first end 3121 of the second connecting portion 312, and a second end 512 of the first back member 51 can be pivotally connected to a first end 521 of the second back member 52. A second end 522 of the second back member 52 can be pivotally connected to the third back member 53. A first end 531 of the third back member 53 can be pivotally connected to the connecting member 17, and a second end 532 of the third back member 53 can be pivotally connected to the fourth back member 54. The fourth back member 54 can be pivotally connected to the back plate 59. A first end 551 of the fifth back member 55 can be pivotally connected to the fourth back member 54, and a second end 552 of the fifth back member 55 can be pivotally connected to the sixth back member 56. A first end 571 of the seventh back member 57 can be pivotally connected to the sixth back member 56. A second end 572 of the seventh back member 57 can be pivotally connected to the connecting member 17. A first end 581 of the eighth back member 58 can be pivotally connected to the sixth back member 56, and a second end 582 of the eighth back member 58 can be pivotally connected to the angle adjusting member 510. And the angle adjusting member 510 can be pivotally connected to the back plate 59 at the same time.

The second connecting portion 312 can drive the first back member 51 to rotate relative to the back plate 59. The first back member 51 can drive the third back member 53 to rotate relative to the connecting member 17 through the second back member 52. When the sixth transmission member 36 makes the back component 50 being fully extended, the sixth transmission member 36, the first back member 51, and the back plate 59 can move together under the driving of the driving member 21. The third back member 53 can rotate relative to the connecting member 17. The third back member 53 can drive the second back member 52 to rotate relative to the back plate 59, and make the fifth back member 55 rotate relative to the fourth back member 54. The fifth back member 55 can push the sixth back member 56 to rotate relative to the back plate 59. The sixth back member 56 can drive the seventh back member 57 to rotate relative to the connecting member 17. The fifth back member 55 can push the seventh back member 57, and the seventh back member 57 can drive the angle adjusting member 510 to rotate relative to the back plate 59, thereby realizing the angle adjustment of the back component 50.

The angle adjustment of the back component 50 can satisfy various postures of the user and improve the comfort of using.

Figure 13:
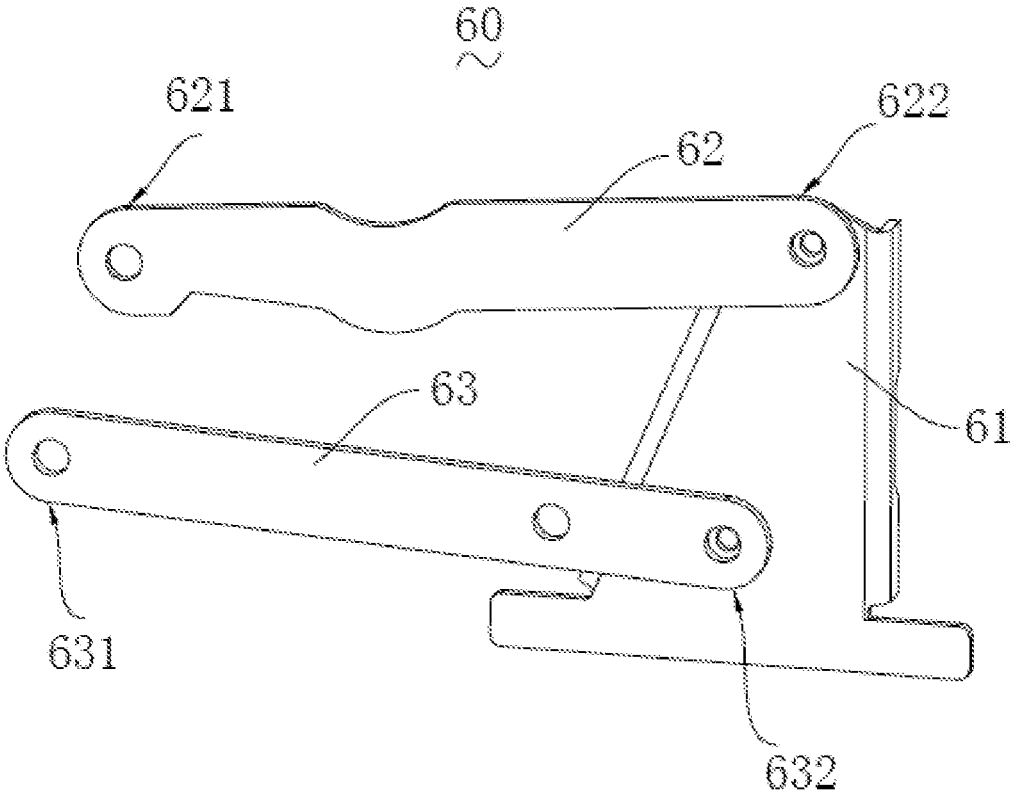
FIG. 13 is a schematic view of a lifting component of the chair support structure of FIG. 1.
Figure 14:
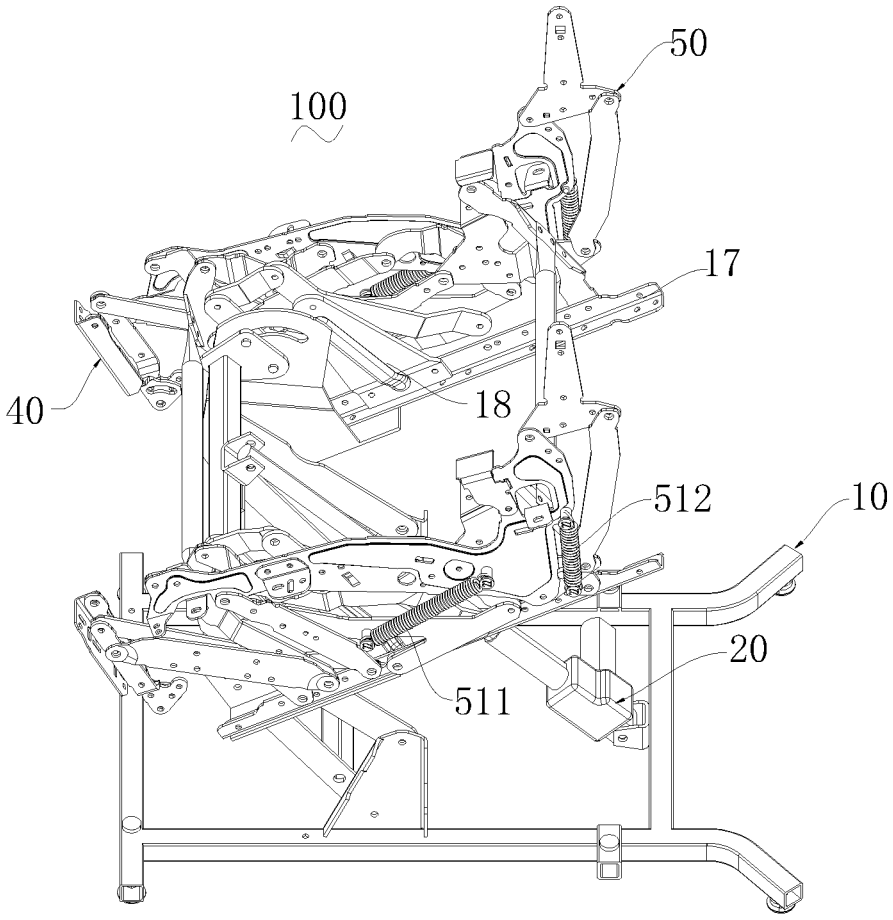
FIG. 14 is a schematic view of the chair support structure of FIG. 1 in a lifted state.

Referring to FIG. 13 and FIG. 14, the chair support structure 100 can further include a lifting component 60 including a fixing member 61, a first lifting member 62, and a second lifting member 63. The fixing member 61 can be fixed to the base 10. A first end 621 of the first lifting member 62 can be pivotally connected to the sixth transmission member 36, and a second end 622 of the first lifting member 62 can be pivotally connected to the fixing member 61. A first end 631 of the second lifting member 63 can be pivotally connected to the sixth transmission member 36, and a second end 632 of the second lifting member 63 can be pivotally connected to the fixing member 61. And the first lifting member 62 can be spaced from the second lifting member 63.

When the driving member 21 drives the guide portion 351 being at one end of the guide groove 361 close to the leg component 40, the leg component 40 is in a contracted state. The drive member 21 can continue to drive the guide portion 351, and the guide portion 351 can abut against a side wall of the guide groove 361 and the sixth transmission member 36 can rotate relative to the fixing member 61 through the first lifting member 62 and the second lifting member 63. The lifting portion 362 can pull the connecting member 17. Because the first transmission component 30, the leg component 40 and the back component 50 are all connected to the connecting member 17 and the connecting member 17 can raise and rotate relative to the base 10, thereby realizing a height adjustment of the chair support structure 100.

The height of the chair support structure 100 can be adjusted by the connecting member 17, which is convenient for the user to stand, and is beneficial to improve the comfort of using.

The chair support structure 100 can further include a first elastic member 511 and a second elastic member 512. One end of the first elastic member 511 can be connected to the back plate 59, and the other end of the first elastic member 511 can be connected to the first connection portion 311. One end of the second elastic member 512 can be connected to the back plate 59, and the other end of the second elastic member 512 can be connected to the sixth back member 56. The arrangement of the first elastic member 511 can provide a pulling force for the sixth transmission member 36 when the leg component 40 is contracted, thereby making the contraction movement of the leg component 40 more coordinated and smooth, while preventing the chair support structure 100 from firstly lifting its height, to ensure that the leg component 40 is contracted at first, and then perform the height lifting. The second elastic member 512 can pull the sixth back member 56 toward the back plate 59. At this time, the second elastic member 512 can ensure that the back component 50 can be first adjusted its angle and then the leg component 40 can be extended. The first elastic member 511 and the second elastic member 512 can allow the chair support structure 100 to move regularly and improve the stability of the chair support structure 100.

In this embodiment, both the first elastic member 511 and the second elastic member 512 can be springs. The spring is simple to make, inexpensive, and the elastic performance is good. It can be understood that in other embodiments, the first elastic member 511 and the second elastic member 512 may also be selected as other elastic elements.

It should be noted that the chair support structure 100 can have a symmetrical structure, and the components can be provided symmetrically on the first support rod 11 and the third support rod 13. The chair support structure 100 can further include a first connection rod 71, a second connection rod 72, a third connecting rod 73 and a fourth connecting rod 74. Two ends of the first connecting rod 71 are respectively connected to an intermediate plate close to the first support rod 11 and another intermediate plate close to the third support rod 13. The driving member 21 can be pivotally connected to the first connecting rod 71 in order to drive the components on both sides to achieve corresponding movement through the first connecting rod 71. Both ends of the second connecting rod 72 can be respectively connected to one third back member close to the first support rod 11 and another third back member close to the third support rod 13. Two ends of the second connecting rod 73 can be respectively connected to one sixth transmission member close to the first support rod 11 and another sixth transmission member close to the third support rod 13. Both ends of the third connection rod 74 can be respectively connected to one seventh back member close to the first support rod 11 and another seventh back member close to the third support rod 13. The first connecting rod 71, the second connecting rod 72, the third connecting rod 73, and the fourth connecting rod 74 can enhance the overall stability of the chair support structure 100, making the chair support structure 100 more stable during transmission, and improving security for the support structure 100.

The present disclosure also provides a chair including the chair support structure 100.

The chair including the chair support structure 100 can reduce its production cost have a better application prospect.

The technical features of the above-described embodiments may be in any combination. For the sake of brevity of description, all possible combinations of the technical features in the above embodiments are not described. However, as long as there is no contradiction between the combinations of these technical features, all of the combinations should be considered as within the scope of this disclosure.

Although the devices have been described and illustrated using certain embodiments, however, the disclosure is not limited by the precise details set forth above. Many variations and modifications will be evident to those skilled in the art and may be made without departing from the spirit and scope of the disclosure.

What is claimed is:

1. A chair support structure, comprising a base, a driving component, a first transmission component, a leg component, and a back component, wherein the driving component is connected to the base, the first transmission component is connected to the driving component, and both the leg component and the back component are connected to the first transmission component, the first transmission component comprises a first transmission member, the first transmission member comprises a first connection portion and a second connection portion, the first connection portion and the second connection portion each has a first end and a second end opposite to each other, the first end of the first connection portion is pivotally connected to the leg component, the second end of the first connection portion is fixed to the second connection portion, an angle is formed between the first connection portion and the second connection portion, the first end of the second connection portion is pivotally connected to the back component, the second end of the second connecting portion is connected to the driving component, the driving component comprises a driving member, the driving member is connected to the base, an output end of the driving member is connected to the second end of the second connecting portion, the driving member is configured for driving the first transmission member to move relative to the base, resulting in the first connecting portion driving the leg component being extended or contracted, and the second connection portion drives the back component to rotate relative to the base to adjust an angle of the back component, the first transmission component further comprises a second transmission member, a third transmission member, a fourth transmission member, a fifth transmission member, and a sixth transmission member, each of which has a first end and a second end opposite to each other, the first end of the second transmission member is pivotally connected to the second end of the second connection portion, the second end of the second transmission member is pivotally connected to the first end of the third transmission member, a middle portion of the third transmission member between the first end and the second end is pivotally connected to the base, the second end of the third transmission member is pivotally connected to the first end of the fourth transmission member, and the second end of the fourth transmission member is pivotally connected to the first end of the fifth transmission member, the second end of the fifth transmission member is pivotally connected to the sixth transmission member, and the sixth transmission member is pivotally connected to the base, a guide groove is disposed on the sixth transmission member, and the fifth transmission member is provided with a guide portion coupled to the guide groove, which is slidable along the guide groove, the output end of the driving member is connected to the fifth transmission member, and the driving member is configured to drive the fifth transmission member, the fourth transmission member, the third transmission member and the second transmission member to move, resulting in driving the first transmission member to move.

2. The chair support structure of claim 1, wherein an edge of the sixth transmission member extends outward to form a lifting portion abutting against the base, the chair support structure further comprises a connecting member abutting against the lifting portion, and the first transmission component, the leg component and the back component are pivotally connected to the connecting member.

3. The chair support structure of claim 2, wherein the chair support structure further comprises a support member having a first end and a second end opposite to each other, the first end of the support member is fixed to the connecting member and the second end of the support member is pivotally connected to the middle portion of the third transmission member, and the third transmission member is rotatable relative to the support member, driven by the driving member, and drives the second transmission member and the first transmission member to rotate.

4. The chair support structure of claim 2, wherein the back component comprises a first back member, a second back member, a third back member, a fourth back member, a fifth back member, a sixth back member, a seventh back member, an eighth back member, a back plate, and an angle adjusting member, the back plate is pivotally connected to the leg component, a first end of the first back member is pivotally connected to a first end of the second connecting portion, a second end of the first back member opposite to the first end thereof is pivotally connected to a first end of the second back member, a second end of the second back member opposite to the first end thereof is pivotally connected to the third back member, a first end of the third back member is pivotally connected to the connecting member, a second end of the third back member opposite to the first end thereof is pivotally connected to the fourth back member, the fourth back member is pivotally connected to the back plate, a first end of the fifth back member is pivotally connected to the fourth back member, a second end of the fifth back member opposite to the first end thereof is pivotally connected to the sixth back member, a first end of the seventh back member is pivotally connected to the sixth back member, and a second end of the seventh back member opposite to the first end thereof is pivotally connected to the connecting member, a first end of the eighth back member is pivotally connected to the sixth back member, a second end of the eighth back member opposite to the first end thereof is pivotally connected to the angle adjusting member, and the angle adjusting member is pivotally connected to the back plate at the same time.

5. The chair support structure of claim 4, further comprising a first elastic member and two ends of the first elastic member are connected to the back plate and the first connection portion, respectively.

6. The chair support structure of claim 5, further comprising a second elastic member, and two ends of the second elastic member are connected to the back plate and the sixth back member, respectively.

7. The chair support structure of claim 2, further comprising a lifting component, wherein the lifting component comprises a fixing member, a first lifting member and a second lifting member, the fixing member is fixed to the base, a first end of the first lifting member is pivotally connected to the sixth transmission member, a second end of the first lifting member opposite to the first end thereof is pivotally connected to the fixing member, a first end of the second lifting member is pivotally connected to the sixth driving member, and a second end of the second lifting member opposite to the first end thereof is pivotally connected to the fixing member, the driving member is configured to drive the sixth transmission member to rotate relative to the fixing member through the first lifting member and the second lifting member, and the sixth transmission member is configured to cause the connecting member to rotate relative to the base through the lifting portion.

8. The chair support structure of claim 1, wherein the driving member is a screw motor.

9. The chair support structure of claim 1, wherein the first connection portion and the second connection portion are connected with each other and form an integral structure.

10. A chair, comprising the chair support structure of claim 1.

11. The chair of claim 10, wherein an edge of the sixth transmission member extends outward to form a lifting portion abutting against the base, the chair support structure further comprises a connecting member abutting against the lifting portion, and the first transmission component, the leg component and the back component are pivotally connected to the connecting member.

12. The chair of claim 11, wherein the chair support structure further comprises a support member having a first end and a second end opposite to each other, the first end of the support member is fixed to the connecting member and the second end of the support member is pivotally connected to the middle portion of the third transmission member, and the third transmission member is rotatable relative to the support member, driven by the driving member, and drives the second transmission member and the first transmission member to rotate.

13. The chair of claim 11, wherein the back component comprises a first back member, a second back member, a third back member, a fourth back member, a fifth back member, a sixth back member, a seventh back member, an eighth back member, a back plate, and an angle adjusting member, the back plate is pivotally connected to the leg component, a first end of the first back member is pivotally connected to a first end of the second connecting portion, a second end of the first back member opposite to the first end thereof is pivotally connected to a first end of the second back member, a second end of the second back member opposite to the first end thereof is pivotally connected to the third back member, a first end of the third back member is pivotally connected to the connecting member, a second end of the third back member opposite to the first end thereof is pivotally connected to the fourth back member, the fourth back member is pivotally connected to the back plate, a first end of the fifth back member is pivotally connected to the fourth back member, a second end of the fifth back member opposite to the first end thereof is pivotally connected to the sixth back member, a first end of the seventh back member is pivotally connected to the sixth back member, and a second end of the seventh back member opposite to the first end thereof is pivotally connected to the connecting member, a first end of the eighth back member is pivotally connected to the sixth back member, a second end of the eighth back member opposite to the first end thereof is pivotally connected to the angle adjusting member, and the angle adjusting member is pivotally connected to the back plate at the same time.

14. The chair of claim 13, further comprising a first elastic member and two ends of the first elastic member are connected to the back plate and the first connection portion, respectively.

15. The chair of claim 14, further comprising a second elastic member and two ends of the second elastic member are connected to the back plate and the sixth back member, respectively.

16. The chair of claim 11, further comprising a lifting component, wherein the lifting component comprises a fixing member, a first lifting member and a second lifting member, the fixing member is fixed to the base, a first end of the first lifting member is pivotally connected to the sixth transmission member, a second end of the first lifting member opposite to the first end thereof is pivotally connected to the fixing member, a first end of the second lifting member is pivotally connected to the sixth driving member, and a second end of the second lifting member opposite to the first end thereof is pivotally connected to the fixing member, the driving member is configured to drive the sixth transmission member to rotate relative to the fixing member through the first lifting member and the second lifting member, and the sixth transmission member is configured to cause the connecting member to rotate relative to the base through the lifting portion.

17. The chair of claim 10, wherein the driving member is a screw motor.

18. The chair support structure of claim 10, wherein the first connection portion and the second connection portion are connected with each other and form an integral structure.

* * * * *